US005458512A

United States Patent [19]

Takano et al.

[11] Patent Number: 5,458,512

[45] Date of Patent: Oct. 17, 1995

[54] MOUNTING AND GROUNDING CONNECTORS FOR ELECTRICAL COMPONENTS

[75] Inventors: Tsunesuke Takano; Kouichi Sinzawa, both of Tokyo, Japan

[73] Assignee: Daiichi Denso Buhin Co., Inc., Japan

[21] Appl. No.: 280,873

[22] Filed: Jul. 27, 1994

[30] Foreign Application Priority Data

Aug. 18, 1993 [JP] Japan ..... 5-225150

[51] Int. Cl.[6] ..... H01R 4/30

[52] U.S. Cl. ..... 439/801

[58] Field of Search ..... 439/92, 97, 101, 439/572, 573, 801; 403/408.1

[56] References Cited

U.S. PATENT DOCUMENTS 5,037,333 8/1991 Baubles ..... 439/801

5,108,296 4/1992 Takano et al. ..... 439/92

*Primary Examiner*—Gary F. Paumen

*Attorney, Agent, or Firm*—Nixon & Vanderhye

[57] ABSTRACT

A connector for mounting and grounding electrical components to an underlying electrically conductive support structure by a mounting screw includes an electrically insulating mounting block which defines at least one mounting hole, and an electrically conductive bus bar which is operatively associated with the mounting block. The bus bar is bent to establish a first leg which is sandwiched between the electrically insulating mounting block and the electrically conductive support structure, and a second leg which defines a flat surface which is disposed within the mounting hole of the electrically insulating mounting block. At least one bent piece is attached to the second leg and bent so as to bound at least an interior surface portion of the mounting hole defined in the electrically insulating mounting block. The first leg of the bus bar makes planar contact with the electrically conductive support structure with the bus bar being positionally fixed in place by the second leg disposed within the mounting hole when the mounting screw is inserted and threaded thereinto.

9 Claims, 5 Drawing Sheets

MOUNTING AND GROUNDING CONNECTORS FOR ELECTRICAL COMPONENTS

FIELD OF INVENTION

The present invention relates to a conductive connector suitable for mounting and grounding an electrical component, such as an interior lamp, to the painted surface of an underlying conductive support structure such as the surface of an automobile body.

BACKGROUND OF THE INVENTION

U.S. Pat. No. 5,108,296, discloses a technique for body grounding by opening a hole in the painted surface of a conductive attaching body, such as an automobile body, and fastening together a lead wire and bus bar with screws.

In this example of the prior art, a conductive member having a bent piece is inserted into a hole formed adjacent to an attachment hole of an insulated mounting block. The surface of the mounting block on which a conductive member is arranged makes planar contact with a conductive support structure so that the mounting block may be tightly fastened to a hole of the conductive support structure with a conductive screw inserted through the attachment hole. The end of the bent piece of the conductive member is connected to the inner surface of the hole of the conductive support structure with the conductive screw while making "scratching" contact with the inner surface of the screw head.

In attaching an interior lamp and the like by fastening with screws to the automobile body, since there are no reinforcing members (particularly on the inner surface and periphery of the cylindrical attachment hole of a plastic attached body), a problem is encountered wherein a completely satisfactory attachment state cannot always be obtained due to the cracking, cutting, tearing or breaking off of the mounting block by virtue of the powerful twisting force of the set screws.

In addition, there is also a problem of the conductive member, integrated into a single unit with a bus bar, becoming displaced by the turning force of the screws.

Furthermore, since the mounting block is attached by only its surface on which a conductive member is arranged, there has also been the problem of it being subjected to restrictions on its direction of attachment.

That is, since handling of lead wires and bus bars is troublesome at visible locations such as door switches and interior electrical components such as interior lamps (not to mention locations hidden from sight), the screws sometimes become loose due to vibrations and the like. As a result, numerous problems arose which required the use of spring washers.

Consequently, although there are other prior art examples which prevent partial damage to the mounting block by the screws, for example, by embedding a reinforcing ring by insertion-molding in line with the attachment hole, there is still the problem of molding costs becoming expensive due to the need for plastic insert molding means.

Therefore, although it is possible to consider simply tightly fitting a reinforcing ring in the cylindrical attachment hole, a press machine is required which also results in poor workability. In contrast, the case where the reinforcing ring is loosely fit, there are problems such as the ring easily falling out or still requiring the use of a spring washer.

SUMMARY OF THE INVENTION

In order to eliminate each of the above-mentioned problems, the present invention improves the shape of the attachment hole of the attached body by inserting a cylindrical bent piece, of which at least one leg thereof extends from a conductive member and is formed into a fiat surface, along at least a portion of the inner surface of the attachment hole of the mounting block. The mounting block may then be fastened to a conductive support structure with a conductive screw.

Accordingly, an object of the present invention is to reinforce the periphery of the attachment hole with the bent piece, and to positionally lock the conductive member so that it does not become displaced during assembly. The attachment direction of the mounting block is thus accommodated to an extent that the conductive screw does not become loosened by the resilient bending force exerted on the bent piece by the mounting screw. The need for a spring washer is thereby prevented.

The present invention noted above is accomplished by arranging a conductive member, having a bent piece aligned with the inner surface of an attachment hole of an insulated mounting block made of plastic and the like. The bent piece is inserted into the attachment hole and slightly protrudes from its inner surface. One leg of the attached body makes planar contact with a conductive structure. By tightly fastening the mounting block to the hole of the conductive support structure with a conductive screw inserted through the bent piece within the attachment hole, the bent piece of the conductive member is forcibly bent. As a result, its end is connected to the inner surface of the hole of said conductive support structure with the conductive screw so as to maintain electrical continuity.

When the mounting block is fastened to the hole of a conductive support structure with a conductive screw inserted into the attachment hole of the mounting block, the inner surface and periphery of said attachment hole can be reinforced, since the conductive bent piece is present within and bounds the inner surface of the attachment hole of the mounting block. The mounting block may thus be securely fastened to the painted surface of a conductive support structure without being cut, torn or broken off by the twisting force of the conductive screw.

Moreover, during this fastening, since the bent piece of the conductive member is pushed against the painted surface of the conductive support structure by the twisting force of the conductive screw, the conductive screw can be threaded at a angle to the conductive support structure with the conductive screw being positioned in the hole of the conductive support structure. This forcibly pushes the projecting portion of the bent piece into the attachment hole with the inner surface of the head of the conductive screw.

In addition, by tightly fastening the mounting block in the hole of the conductive support structure with a conductive screw inserted through an attachment hole of the mounting block, the projecting portion of the bent piece of the conductive member is forcibly pushed into the attachment hole by the powerful twisting force of the conductive screw. The bent piece thus makes resilient contact with the inner surface of the head of the conductive screw by strongly bending the bent piece with slight looseness. The conductive member is therefore able to be connected to the inner surface of the hole of the conductive support structure so as to maintain electrical continuity. The conductive screw is thus not inadvertently loosened by external disturbances such as vibrations and the like due to the powerful resilient contact friction of the bent piece. As a result, secure resilient contact with the inner surface of its head portion is ensured.

According to another embodiment of the present invention, the bent piece of a conductive member is pushed against the painted surface of a conductive support structure by the twisting force of a conductive screw during fastening. In this regard, the conductive screw is threaded into an attachment hole while a projection provided on the bent piece forcibly scratches and cuts into the inner surface of the head portion of the conductive screw. The conductive screw may thus be threaded at a right angle to the conductive attaching body.

As a result of the bent piece being tightly clamped by a projecting residual portion between the inside of the head of the conductive screw and the painted surface of the conductive support structure wherein the majority of its projection has been scratched and cut away, the conductive member can securely be connected to the conductive support structure at the inner surface of its hole through the conductive screw by means of the bent piece to thereby maintain electrical continuity.

DETAILED DESCRIPTION OF THE PREFERRED EXEMPLARY EMBODIMENTS

The following provides an explanation of a first embodiment of the connector according to the present invention with reference to the drawings.

Figure 2:
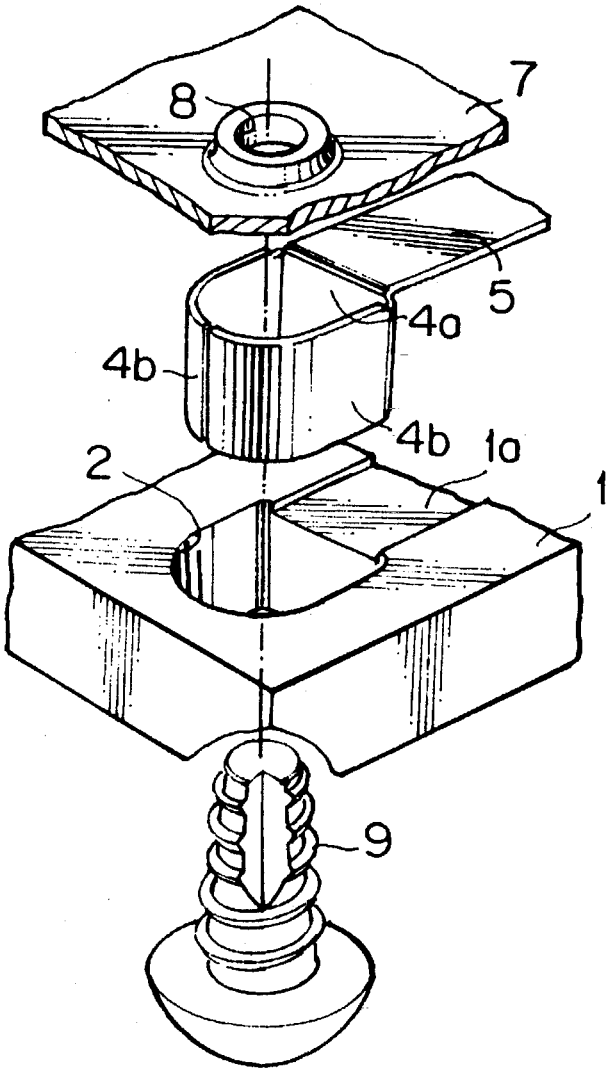
FIG. 2 is an exploded perspective view showing the embodiment of the present invention depicted in FIG. 1.
Figure 3A:
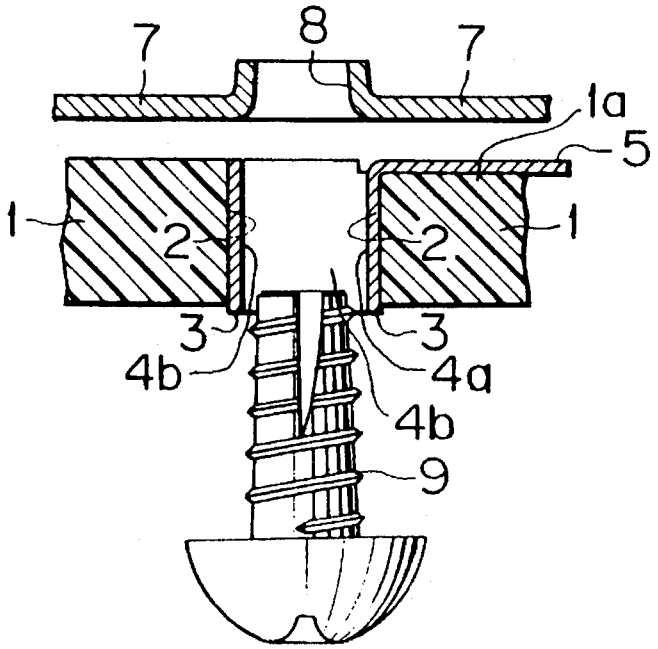
FIGS. 3A and 3B are cross-sectional views during the course of assembly of the embodiment of the present invention depicted in FIG. 1.

First, with respect tot he basic construction of the present invention, on a conductive member 5, in the form of a bus bar having bent pieces 4*a* and 4*b* is inserted in attachment hole 2 of an insulated mounting block 1 made of plastic and the like (see FIGS. 2 and 3A). An annular edge 3 of the bent pieces 4*a* and 4*b* slightly projects from the attachment hole 2 beyond the body 1. The conductive member 5 includes a planar leg 5*a* which is arranged on the surface of the mounting block 1, for example within flat groove 1*a* so as to be sandwiched between the mounting block 1 and the support structure 7.

Figure 1:
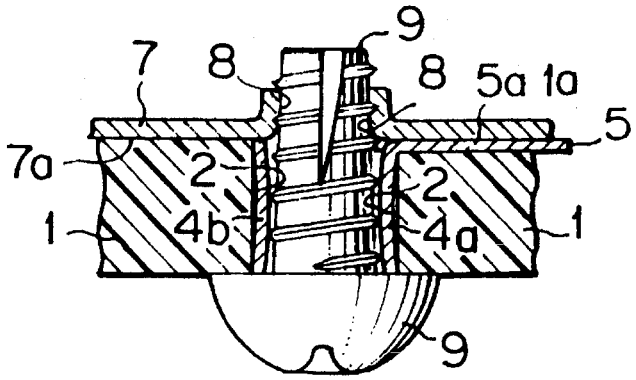
FIG. 1 is a cross-sectional view showing an embodiment of the connector according to the present invention.
Figure 3B:
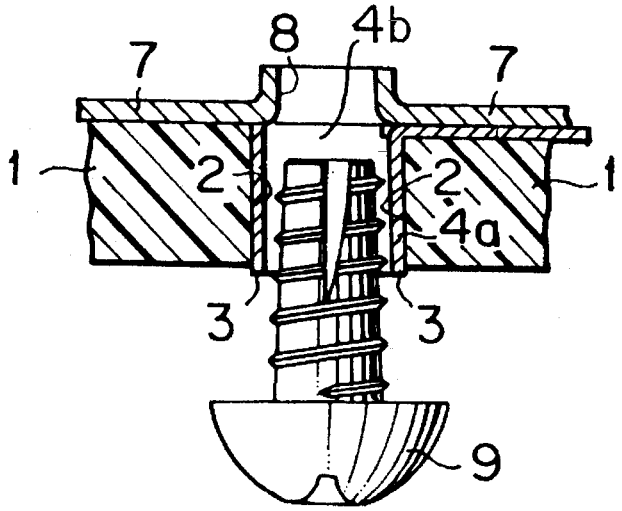

The surface of the mounting block 1 on which the conductive member 5 is arranged makes planar contact with metal conductive attaching body 7 via leg 5*a* as shown in FIG. 3B. The mounting block 1 is tightly fastened to hole 8 of conductive support structure 7 as shown in FIG. 1, (or to a nut welded to conductive support structure 7 in place of this hole 8), with conductive screw 9, which may be in the form of a tapping screw and the like inserted through the attachment hole 2. Leading annular projection edge 3 of bent pieces 4*a*, 4*b* of the conductive member 5 is thus forcibly pushed into the attachment hole 2 by the powerful twisting force of the conductive screw 9, thus enabling bent pieces 4*a*, 4*b* to be strongly bent with slight looseness and make resilient contact with the inner surface of the head of conductive screw 9 as shown in FIG. 1. As a result, the conductive member 5 is able to be connected to the inner surface of hole 8 of conductive attaching body 7 to thereby maintain electrical continuity.

The following provides an explanation of the operation of the present invention.

Since paint is peeled from the inner surface of hole 8 formed in conductive support structure 7 during drilling or burring, the inner surface of the hole 8 (or a nut welded to conductive support structure 7) is likewise electrically conductive.

When the mounting block I is fastened to hole 8 of the conductive support structure 7 with conductive screw 9 inserted through bent pieces 4*a* and 4*b* as shown in FIG. 3A inside attachment hole 2 of mounting block 1, the inner surface and periphery of attachment hole 2 can be reinforced by bent pieces 4*a* and 4*b* that is, the conductive bent pieces 4*a* and 4*b* are present inside attachment hole 2 of attached body 1 and are aligned with its inner surface thereby; providing structural reinforcement. The mounting block 1 nay thus be securely fastened to painted surface 7*a* of conductive support structure 7 (see FIG. 1) without being cut or damaged by the twisting force of conductive screw 9, and without displacing the bus bar 5 since one leg of the bus bar 5 is in the form of a fiat surface defined by bent piece 4*a*.

During this fastening, while bent pieces 4*a* and 4*b* of conductive member 5 are pushed against the painted surface of conductive support structure 7 by twisting force of conductive screw 9, the conductive screw 9 may be threaded and fastened at a right angle, since the conductive screw 9 is threaded into hole 8 of the conductive support structure 7 while the projection edge 3 of bent pieces 4*a* and 4*b* is forcibly pushed into attachment hole 2 by the inner surface of the head of conductive screw 9.

Following this fastening, conductive screw 9 does not become inadvertently loosened by external disturbances, such as vibrations and the like, due to the powerful resilient contact friction of the bent piece 4*b* securely making resilient contact with the inner surface of the screw head.

Figure 4:
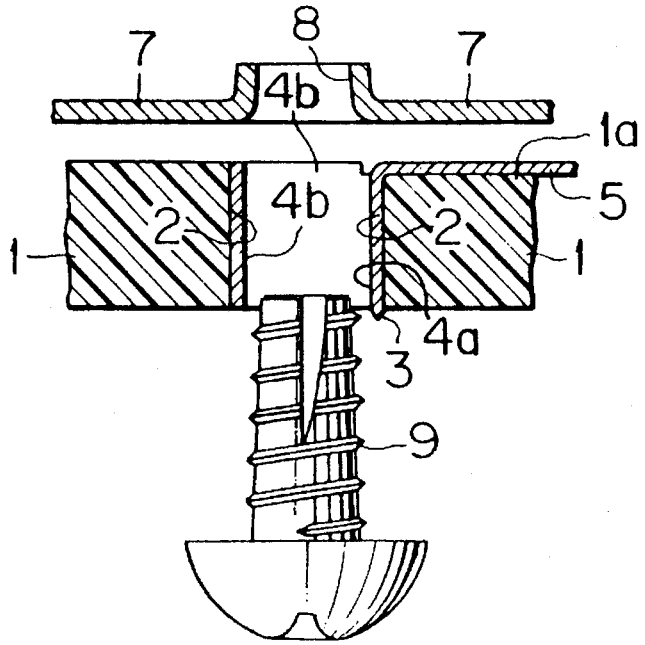
FIG. 4 is a cross-sectional view during the course of assembly of another embodiment of the present invention.
Figure 5A:
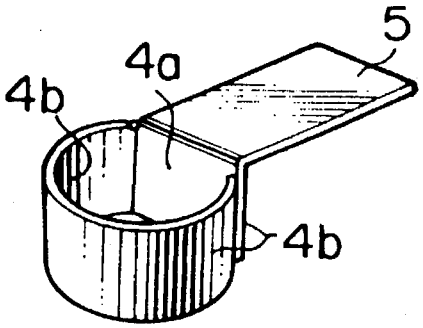
FIGS. 5A and 5B are perspective views showing other examples of bent pieces of the conducting member.
Figure 6A:
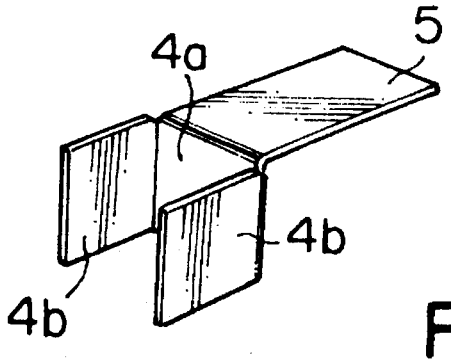
FIGS. 6A and 6B are perspective views showing other examples of bent pieces of the conducting member.
Figure 7A:
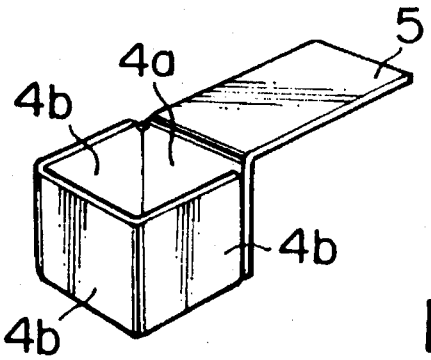
FIGS. 7A and 7B are perspective views showing other examples of bent pieces of the conducting member.

The shape of bent pieces 4*a* and 4*b* that are formed on conductive member 5 is not limited to a curved cylinder as shown in FIGS. 1–4, but instead may have one of the various shapes shown in each FIGS. 5A, 6A and 7A.

Figure 8:
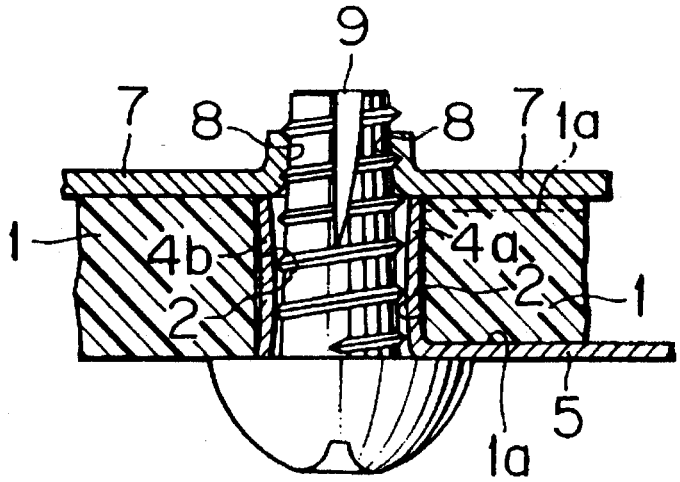
FIG. 8 is a cross-sectional view showing another embodiment of the present invention.
Figure 9:
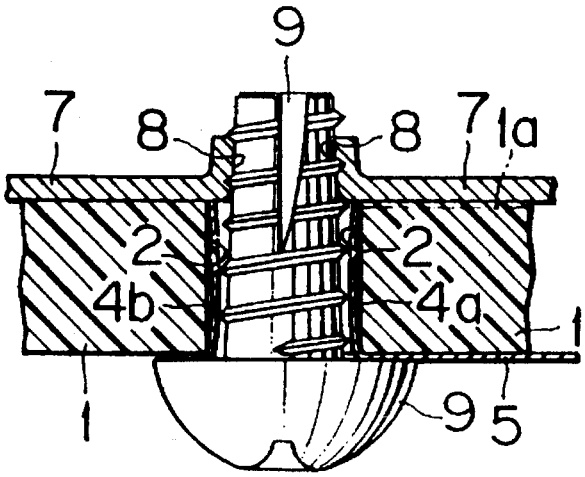
FIG. 9 is a cross-sectional view showing another embodiment of the present invention.

Although an example of attaching the mounting block 1 is described in the above-mentioned embodiment wherein its surface on which conductive member 5 is provided makes contact with conductive support structure 7, the mounting block 1 may also be fastened with conductive screw 9 by having the surface of the mounting block 1 on which a conductive member is not arranged make contact with conductive support structure 7 as shown in FIGS. 8 and 9.

The following provides an explanation of a second embodiment of the present invention with reference to the drawings.

As shown in FIG. 4, the bent pieces 4*a* and 4*b* may have a projection 3 which slightly protrudes from attachment hole 2 of insulated mounting block 1. The bent pieces 4a, 4b are inserted into attachment hole 2. The conductive member 5, in the form of a buss bar and the like, is integrated into a single trait with bent pieces 4a and 4b, and includes a leg 5a which is arranged on the surface of the mounting block 1, for example, on flat groove 1a.

As a result of the surface of the mounting block 1 on which the conductive member 5 is arranged so as to make planar contact with metal conductive support structure 7, in the form of an automobile door or chassis, as shown in FIG. 3B, the mounting block 1 may be tightly fixed to hole 8 of the conductive support structure 7 as shown in FIG. 3B (or to a nut welded to conductive attaching body 7) with conductive screw 9. That is, screw 9 is inserted through the attachment hole 2. As a result, the leading ends of bent pieces 4a and 4b of the conductive member 5 can be connected to the inner surface of hole 8 of the conductive support structure 7 with the screw 9 so as to maintain electrical continuity.

During this fastening, bent pieces 4a and 4b of conductive member 5 are pushed against the painted surface of conductive support structure 7 by twisting force of conductive screw 9. Conductive screw 9 is threaded into attachment hole 2 while projection 3 of bent pieces 4a and 4b is forcibly scratched and cut by the inner surface of the head of conductive screw 9. Conductive screw 9 may thus be threaded and fastened at a right angle to conductive support structure 7.

As a result of the bent pieces 4a and 4b being tightly clamped by means of the residual projection portion 3a between the inside of the head of conductive screw 9 and the painted surface of conductive support structure 7 in the state wherein the majority of its projection 3 has been scratched and cut away, the conductive member 5 can be reliably connected to conductive support structure 7 at the inner surface of its hole 8 through conductive screw 9 by means of its bent pieces 4a and 4b to thus maintain electrical continuity.

Following this fastening, conductive screw 9 does not become inadvertently loosened by external disturbances such as vibrations and the like due to the powerful resilient contact friction resulting from the small residual portion 3a of projection 3 of the above-mentioned bent pieces 4a and 4b securely inserted and making contact with the inner surface of its head.

Figure 5B:
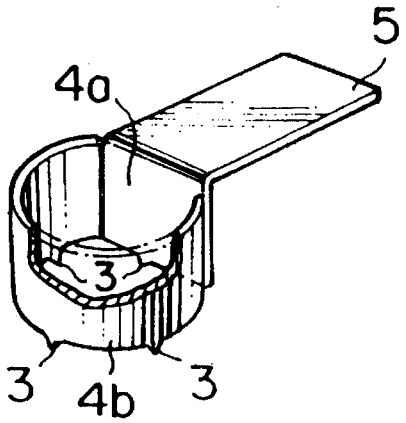
Figure 6B:
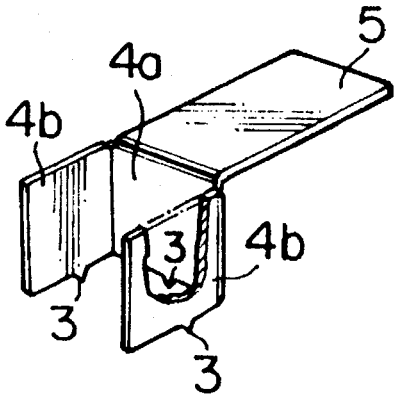
Figure 7B:
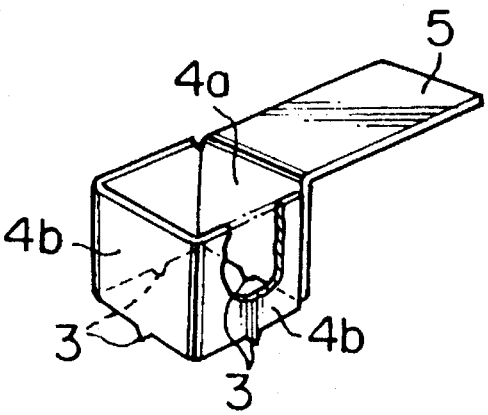

The shape of bent pieces 4a and 4b that may be formed on conductive member 5 is not limited to a curved cylinder, but rather various shapes of bent pieces 4a and 4b can be employed as shown in each of FIGS. 5B, 6B and 7.

As a result of having the construction as explained above, the present invention offers the advantages described below.

When fastening the mounting block 1 to hole 8 of the conductive support structure 7 with conductive screw 9 inserted into attachment hole 2 of mounting block 1, the inner surface and periphery of attachment hole 2 are structurally reinforced by the bent pieces 4a and 4b due to their physical presence within the hole 8. As a result, an advantage in terms of manufacturing is achieved since the mounting block 1 can securely be fastened to painted surface 7a of conductive support structure 7 without being cut or broken off by the twisting force of conductive screw 9.

During this fastening, while bent pieces 4a and 4b of conductive member 5 are being pushed against painted surface 7a of the conductive support, structure 7 by the twisting force of conductive screw 9, conductive screw 9 is able to be threaded and fastened at a right angle to conductive support structure 7 since conductive screw 9 is threaded into hole 8 of conductive support structure 7 while projection 3 of bent pieces 4a and 4b is forcibly pushed into attachment hole 2 by the inner surface of the head of conductive screw 9. The screw 9 is not inadvertently loosened by external disturbance in the form of vibrations and the like due to the powerful resilient contact friction of the bent piece 4b securely making resilient contact with the inner surface of its head, thereby offering the advantage that the need for a spring washer is eliminated.

In addition, since projection 3 of bent pieces 4a and 4b of the conductive member 5 is forcibly pushed into attachment hole 2 by conductive screw 9 inserted in hole 8 of conductive support structure 7 through attachment hole 2 of the mounting block 1 due to the powerful twisting force of the conductive screw 9 as shown in FIG. 1, it is capable of making resilient contact with the inner surface of the head of conductive screw 9. As a result, bent piece 4b is deformed with slight looseness. The conducting member 5 is able to be connected to the inner surface of hole 8 of conductive support structure 7 to thereby maintain electrical continuity, thereby offering numerous advantages including being able to reliably maintain a state of electrical continuity for prolonged time periods.

What is claimed is:

1. A connector for mounting and grounding electrical components to an underlying electrically conductive support structure by means of a mounting screw, said connector comprising:

an electrically insulating mounting block which defines at least one mounting hole; and an electrically conductive bus bar operatively associated with the mounting block, wherein said bus bar is bent to establish a first leg which is sandwiched between said electrically insulating mounting block and said electrically conductive support structure, a second leg which defines a flat surface which is disposed within the mounting hole of the electrically insulating mounting block, and at least one bent piece attached to said second leg and bent so as to bound at least an interior surface portion of said mounting hole defined in said electrically insulating mounting block, wherein said first leg of said bus bar makes planar contact with said electrically conductive support structure such that said bus bar is positionally fixed in place by said second leg disposed within said mounting hole when said mounting screw is inserted and threaded thereinto.

2. The connector as in claim 1, wherein said second leg has a projection edge which projects outwardly from said mounting hole and contacts a head of said mounting screw.

3. The connector as in claim 1, wherein said bus bar includes a pair of bent pieces each connected to a side edge of said second leg and bent to bound substantially the entire interior surface of said mounting hole.

4. The connector as in claim 3, wherein said pair of bent pieces are curved.

5. The connector as in claim 1, wherein said electrically insulating mounting block includes a groove, and wherein said first leg of said bus bar is positioned in said groove.

6. A connector for mounting and grounding electrical components to an underlying electrically conductive support structure by means of a mounting screw having a head and a shank, said connector comprising:

an electrically insulating mounting block which defines at least one mounting hole; and an electrically conductive bus bar operatively associated with the mounting block, wherein said bus bar is bent to establish a first leg which is sandwiched between said electrically insulating mounting block and said electrically conductive support structure, a second leg which is disposed within the mounting hole of the electrically insulating mounting block, and at least one bent piece attached to said second leg and bent so as to bound at least an interior surface portion of said mounting hole defined in said electrically insulating mounting block, wherein said first leg of said bus bar includes a projection edge which extends beyond said electrically insulating block so as to contact the head of the mounting screw and cause said second leg of said bus bar to be inwardly deflected toward the shank of the mounting screw, whereby electrical continuity is maintained.

7. The connector as in claim 6, wherein said bus bar includes a pair of bent pieces each connected to a side edge of said second leg and bent to bound substantially the entire interior surface of said mounting hole.

8. The connector as in claim 7, wherein said pair of bent pieces are curved.

9. The connector as in claim 6, wherein said electrically insulating mounting block includes a groove, and wherein said first leg of said bus bar is positioned in said groove.

* * * * *